US009809378B2

(12) United States Patent
Flynn et al.

(10) Patent No.: US 9,809,378 B2
(45) Date of Patent: Nov. 7, 2017

(54) FLAT SCREEN DISPLAY DEVICE PACKAGING SYSTEM AND METHOD

(71) Applicant: TARGET BRANDS INC., Minneapolis, MN (US)

(72) Inventors: Matt Flynn, Lauderdale, MN (US); Ryan Marquardt, Brooklyn Park, MN (US); Simon Furness, South Woodham Ferrers (GB); Adrian Cox, Thetford (GB)

(73) Assignee: Target Brands, Inc., Minneapolis, MN (US)

( * ) Notice: Subject to any disclaimer, the term of this patent is extended or adjusted under 35 U.S.C. 154(b) by 571 days.

(21) Appl. No.: 14/482,140

(22) Filed: Sep. 10, 2014

(65) Prior Publication Data

US 2016/0068332 A1 Mar. 10, 2016

(51) Int. Cl.

| | |
|---|---|
| ***B65D 75/28*** | (2006.01) |
| ***B65D 85/38*** | (2006.01) |
| ***B65D 81/05*** | (2006.01) |
| ***B65D 65/12*** | (2006.01) |
| ***B65D 75/00*** | (2006.01) |
| ***B65D 81/107*** | (2006.01) |

(52) U.S. Cl.

CPC ..... *B65D 85/38* (2013.01); *B65D 65/12* (2013.01); *B65D 75/006* (2013.01); *B65D 75/28* (2013.01); *B65D 81/051* (2013.01); *B65D 81/107* (2013.01); *B65D 2581/055* (2013.01); *B65D 2585/6837* (2013.01)

(58) Field of Classification Search

CPC ..... B65D 85/38; B65D 75/28; B65D 81/051

USPC ..... 206/451, 523

See application file for complete search history.

(56) References Cited

U.S. PATENT DOCUMENTS

| | | | | |
|---|---|---|---|---|
| 2,861,681 | A | 11/1958 | Lane | |
| 2,917,166 | A | 12/1959 | Lidgard | |
| 3,279,594 | A | 10/1966 | Worthington | |
| 3,348,042 | A | 10/1967 | Umberg et al. | |
| 3,867,874 | A | 2/1975 | O'Neil | |
| 3,939,978 | A | 2/1976 | Thomaswick | |
| 4,113,096 | A * | 9/1978 | Scott | B65D 5/509 206/523 |
| 4,620,633 | A | 11/1986 | Lookholder | |
| 4,699,830 | A | 10/1987 | White | |
| 4,763,789 | A | 8/1988 | Questel et al. | |
| 4,987,997 | A | 1/1991 | Roaszewski et al. | |

(Continued)

OTHER PUBLICATIONS

Office Action from Canadian Patent Application No. 2,872,432, dated Feb. 16, 2015 (4 pages).

*Primary Examiner* — King M Chu

(74) *Attorney, Agent, or Firm* — Hamre, Schumann, Mueller & Larson, P.C.

(57) ABSTRACT

A packaging system and method that can be used to protect a display device. The packaging system includes a front foam panel, a base foam panel and a back foam panel, and two different types of foam for the panels. The base foam panel supports the weight of the display device and absorbs vibrations. The front foam panel protects the screen of the display device by spreading loads over a wider area and reducing the risk of the screen cracking. A back foam panel is made of a lower density foam and supports the display device rear panel in position while taking up the different shapes of the rear panels and allows for variation in thicknesses between different models.

17 Claims, 7 Drawing Sheets

(56) References Cited

U.S. PATENT DOCUMENTS

| | | | | |
|---|---|---|---|---|
| 5,904,251 | A | 5/1999 | Ogata et al. | |
| 6,478,153 | B1 | 11/2002 | King | |
| 6,789,675 | B2 | 9/2004 | Abe et al. | |
| 8,215,484 | B2 | 7/2012 | Lim | |
| 8,322,532 | B2 | 12/2012 | Schafer et al. | |
| 8,474,614 | B2 * | 7/2013 | Hanson | B65D 81/02 206/320 |
| 8,752,703 | B2 | 6/2014 | De Jesus | |
| 2004/0074798 | A1 | 4/2004 | Taylor et al. | |
| 2004/0112789 | A1 | 6/2004 | Robinson | |
| 2006/0207914 | A1 | 9/2006 | Cance et al. | |
| 2008/0093251 | A1 * | 4/2008 | Meyer | B65D 81/022 206/523 |
| 2012/0267276 | A1 | 10/2012 | Hunter et al. | |
| 2013/0167302 | A1 * | 7/2013 | Pearce | A47C 27/144 5/739 |
| 2013/0277253 | A1 | 10/2013 | Hanson et al. | |
| 2013/0277418 | A1 | 10/2013 | Van Berlo et al. | |

* cited by examiner

FLAT SCREEN DISPLAY DEVICE PACKAGING SYSTEM AND METHOD

BACKGROUND

Flat screen display devices such as televisions and computer monitors are fragile. The screens and other portions of these display devices can be damaged during shipment or other transport, as well as during storage, unless protective measures are taken. To protect such display devices during transport, various packaging and transport containers are known in the art. Complicating the protection of display devices during transport is that the rear sides of the display devices come in a number of different shapes, and display devices of similar screen sizes may have different thicknesses depending upon manufacturer and model.

SUMMARY

A packaging system and method are described which can be used to protect a flat screen display device including, but not limited to, during transport and shipment, storage, and the like. The packaging system is designed to accommodate different shapes of the rear sides of the display devices as well as to accommodate different thicknesses of display devices.

The packaging system uses at least three panels of foam material including a front foam panel, a base foam panel, and a back foam panel. Two different types of foam material are used for the panels. In one embodiment, the front foam panel and the base foam panel are made from a foam material, such as, but not limited to, closed-cell polyethylene foam having a higher density than the density of the foam material used to form the back foam panel. The base foam panel supports the weight of the display device and absorbs vibrations during transit. The front foam panel can be the same foam material as the base material because the display screen, the most vulnerable part of the display device, is substantially flat and requires protection from impacts particularly of a point loading nature. The higher density foam of the front foam panel can spread the load over a wider area and can reduce the risk of the display screen cracking.

The back foam panel is made of a foam material having a lower density than the foam material of the front foam panel and the base foam panel. An example of a suitable foam material for the back foam panel includes, but is not limited to, convoluted foam. The foam material for the back foam panel is selected to support the display device in position while accepting the different shapes of the rear sides of display devices and to allow for variation in thicknesses between different models.

The foam panels can be located on a suitable supporting wrap member, such as corrugated cardboard. In one embodiment, the foam panels are positioned off-center to one side of the wrap member to allow positioning of accessories such as the display device stand, cables, and other accessories.

In one embodiment, the packaging system can include a wrap member having a generally rectangular shape including opposite side edges perpendicular to opposite end edges; an open, flat configuration; a closed, folded configuration; an interior surface; and an exterior surface. A back foam panel constructed of a first type of foam material is fixed to the interior surface of the wrap member. A base foam panel is fixed to the interior surface of the wrap member and is spaced from and not directly connected to the back foam panel. The base foam panel is constructed of a second type of foam material that is different from the first type of foam material. In addition, a front foam panel is fixed to the interior surface of the wrap member and is spaced from and not directly connected to the back foam panel or to the base foam panel. The front foam panel is constructed of the second type of foam material. The wrap member is constructed so that it is foldable from the open, flat configuration to the closed, folded configuration. At the closed, folded configuration the wrap member forms a generally rectangular structure with the front foam panel facing the back foam panel, and the back foam panel and the front foam panel are generally perpendicular to the base foam panel.

In use, when the display device is disposed within the wrap member when in the closed, folded configuration, a display screen of the display device faces the front foam panel, a rear side of the display device faces the back foam panel, and an edge of the display device can rest on the base foam panel.

In one embodiment, the wrap member can be provided with suitably located hinges or fold lines along which the wrap member is designed to fold in order to surround the display device when in the closed, folded configuration.

In another embodiment, the packaging system includes a support substrate having opposite side edges perpendicular to opposite end edges; an open, flat configuration; a closed, folded configuration; an interior surface; and an exterior surface. A back foam panel is fixed to the interior surface of the support substrate, with the back foam panel being constructed of one type of foam. A base foam panel is fixed to the interior surface of the support substrate and is spaced from and not directly connected to the back foam panel. The base foam panel is constructed of a type of foam different than the one type of foam. In addition, a front foam panel is fixed to the interior surface of the support substrate and is spaced from and not directly connected to the back foam panel or to the base foam panel, and the front foam panel is constructed of the same type of foam as the base foam panel. The support substrate is foldable from the open, flat configuration to the closed, folded configuration, and in the closed, folded configuration the support substrate forms a generally rectangular structure with the front foam panel facing the back foam panel, and the back foam panel and the front foam panel are generally perpendicular to the base foam panel.

A method of packaging a display device using the packaging system includes disposing the wrap member on a support surface in the open, flat configuration with the interior surface thereof facing upward. The display device is laid display screen-side down on the front foam panel. The wrap member is then folded over the display device to form a generally rectangular structure with the back panel and the back foam panel facing the front panel and the front foam panel, and the upper panel facing the base panel and the base foam panel. The upper panel is then secured to an exterior surface of the back panel, for example using a double-sided adhesive tape that is secured to the interior surface of the upper panel.

DRAWINGS

DETAILED DESCRIPTION

A packaging system and method are described that can be used to package a flat screen display device to protect the display device during transport and shipment, storage, and the like. The packaging system is designed to accommodate different shapes of the rear sides of display devices as well as accommodate differing thicknesses of display devices. The packaging system can also accommodate accessories used with the flat screen display device including, but not limited to, a display device stand, mechanical fasteners, cables, and the like.

As used herein, the phrase "flat screen display device" or just "display device" is intended to encompass any flat screen electronic display device including, but not limited to, flat screen televisions, flat screen computer monitors, and the like. In some embodiments, the packaging system can also be used to package other objects, whether electronic or non-electronic, that may have a shape similar to a flat screen display device.

The language "flat screen" as used herein is intended to encompass display screens that are substantially flat and encompass display screens that may deviate slightly from substantially flat but which are nonetheless considered flat. A display device includes a substantially flat panel display screen on one or a front side thereof, and a rear side opposite the display screen. The shapes and structures of rear sides of display devices typically vary based on the model and/or manufacturer of the display device. Likewise, the thicknesses of each display device measured between the front side and the rear side also typically vary based on the model and/or manufacturer of the display device.

Figure 1:
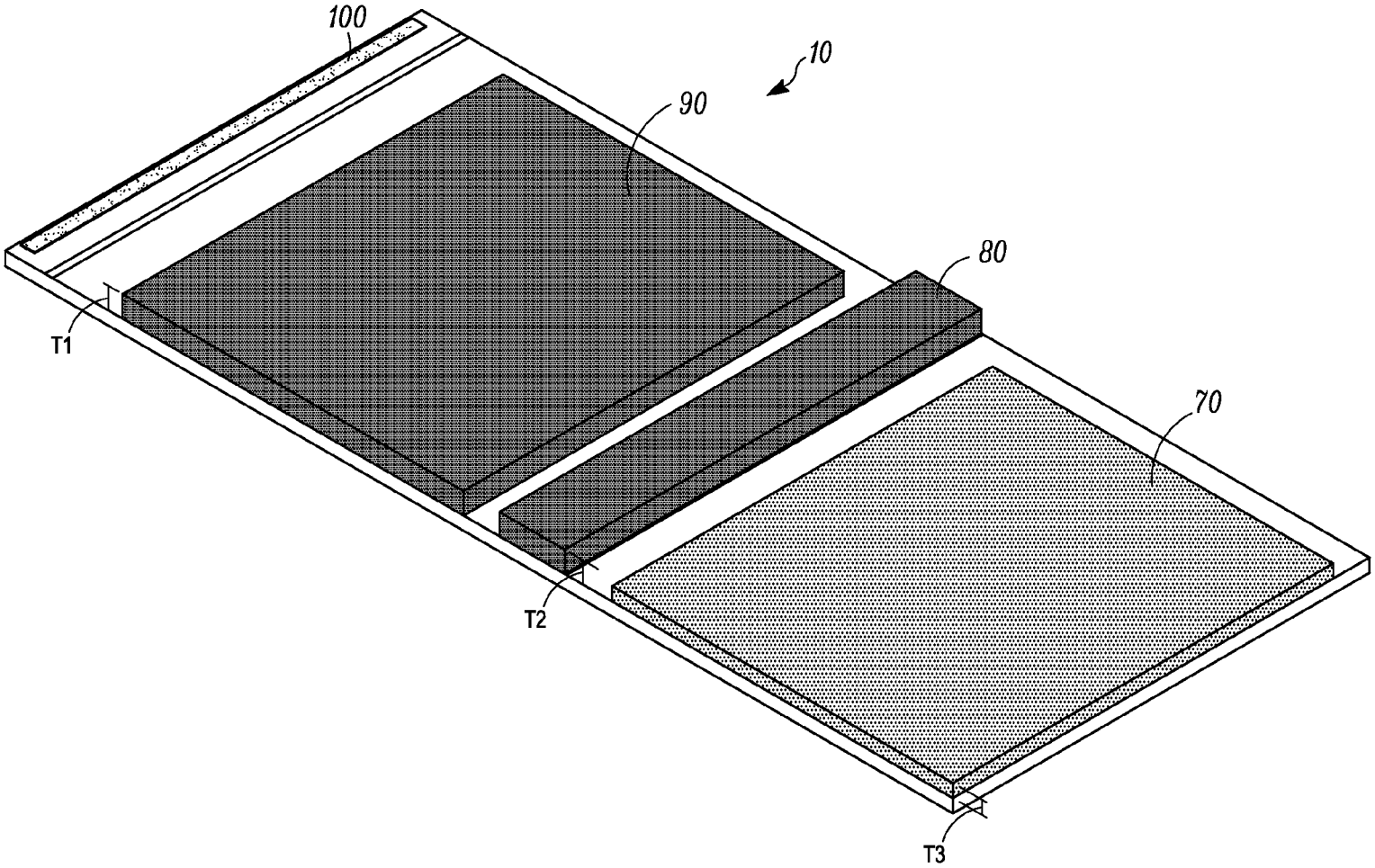
FIG. 1 is a perspective view of the packaging system described herein in an open configuration, according to an embodiment.
Figure 2:
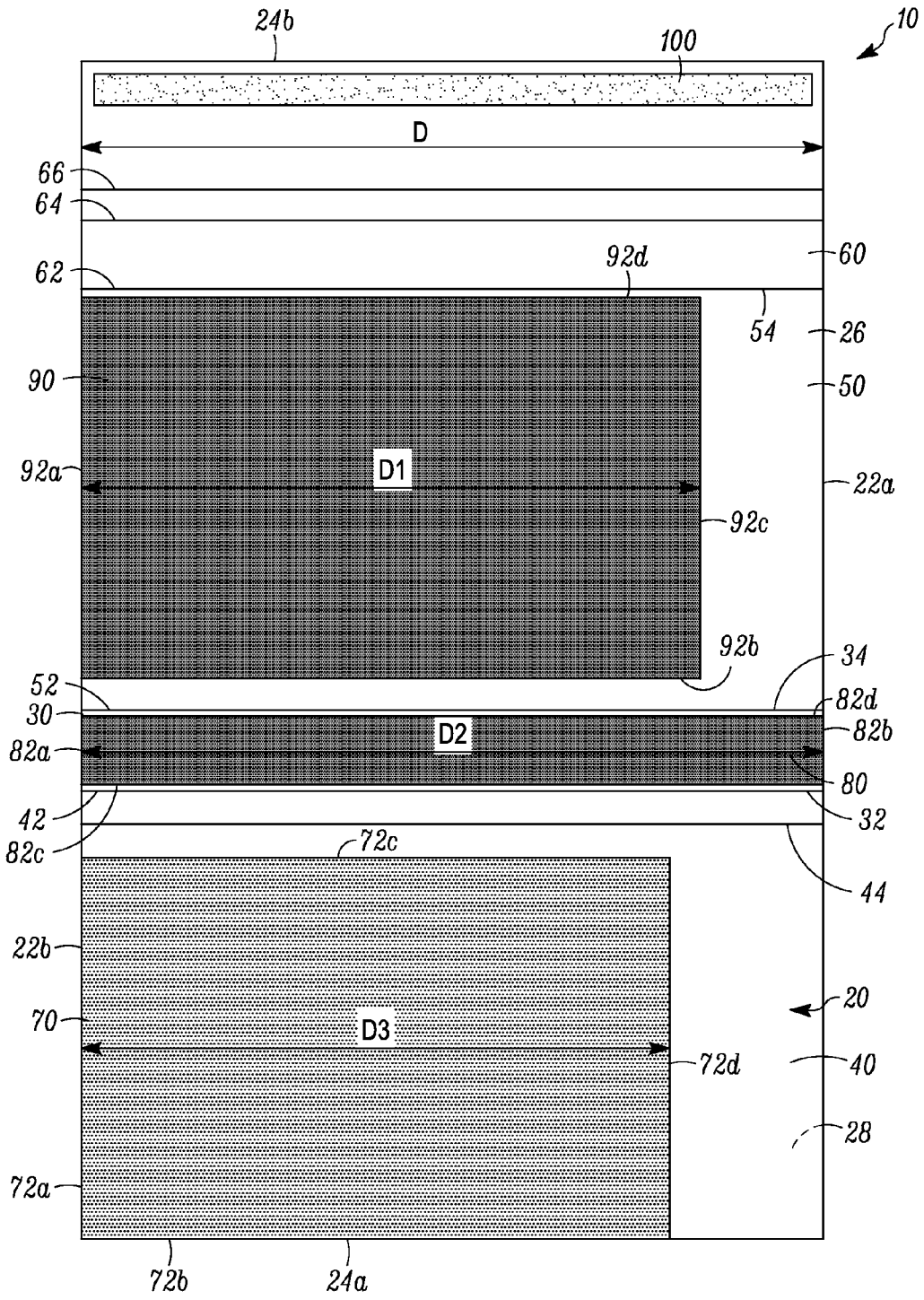
FIG. 2 is a top view of the packaging system of FIG. 1 in the open configuration, according to an embodiment.

FIGS. 1-2 illustrate an embodiment of a packaging system 10 described herein that is configured for packaging a display device. In general, the packaging system 10 is designed to package a display device 12 (see FIG. 4) to protect the display device 12 from damage during transport and shipment, storage, and the like. The packaging system 10 is designed to accommodate different shapes of the rear sides of different models of display devices as well as accommodate differing thicknesses of different models of display devices.

The display device 12 can be any flat screen electronic display device including, but not limited to, a flat screen television, a flat screen computer monitor, and the like. In some embodiments, the packaging system 10 can also be used to package other objects, whether electronic or non-electronic, that may have a shape similar to a flat screen display device.

As best seen in FIG. 2, the packaging system 10 includes a wrap member 20 (also referred to as a support substrate) having a cushioning means. The cushioning means generally encase the display device 12 when the wrap member is folded from an open, flat configuration (shown in FIGS. 1-2) to a closed, folded configuration (shown in FIG. 7). In some embodiments, the cushioning means can include one or more foam panels. In some embodiments, the cushioning means can be formed of any material that is suitable for performing the functions described herein.

The wrap member 20 has a generally rectangular shape with opposite, parallel side edges 22*a*, 22*b*, opposite end edges 24*a*, 24*b* that are perpendicular to the side edges 22*a*, 22*b*, an interior surface 26, and an exterior surface 28. In the open configuration during use, the interior surface 26 is designed to face upwardly while the exterior surface 28 is designed to lay generally flat on a floor or other supporting surface. The wrap member 20 can be formed of any material that is suitable for performing the functions of the wrap member 20 that are described herein or are implicit in the operation of the packaging system 10. In one non-limiting example, the wrap member 20 can be formed from corrugated cardboard.

The wrap member 20 is separated into a number of different sections or panels that optionally are an integral, one-piece construction with one another. In particular, the wrap member 20 includes a rectangular base panel 30 that extends from the side edge 22*a* to the side edge 22*b*, and from a back edge 32 to a front edge 34, the back edge 32 and the front edge 34 extending from the side edge 22*a* to the side edge 22*b* parallel to the end edges 24*a*, 24*b* and perpendicular to the side edges 22*a*, 22*b*.

The wrap member 20 further includes a rectangular back panel 40 that is integrally joined to the back edge 32 of the base panel 30 along a hinge 42 defining a hinge axis that extends from the side edge 22*a* to the side edge 22*b* parallel to the end edges 24*a*, 24*b* and perpendicular to the side edges 22*a*, 22*b*. The hinge 42 defines a fold axis or line along which the base panel 30 and the back panel 40 can fold relative to each other while still maintaining the integral connection between the base panel 30 and the back panel 40. The back panel 40 includes the end edge 24*a*.

Optionally, another hinge 44 can be provided between the base panel 30 and the back panel 40 that defines another fold axis or line, different than the fold axis defined by the hinge 34, along which the base panel 30 and the back panel 40 can fold relative to each other while still maintaining the integral connection between the base panel 30 and the back panel 40, according to an embodiment. The hinge 44 is spaced from the hinge 42, with the hinges 42, 44 permitting the wrap member 20 to fold along the different axes to accommodate different thicknesses of the display device 12.

Still referring to FIG. 2, the wrap member 20 further includes a rectangular front panel 50 that is integrally joined to the front edge 34 of the base panel 30 along a hinge 52 defining a hinge axis that extends from the side edge 22*a* to the side edge 22*b* parallel to the end edges 24*a*, 24*b* and perpendicular to the side edges 22*a*, 22*b*. The hinge 52 defines a fold axis or line along which the base panel 30 and the front panel 50 can fold relative to each other while still maintaining the integral connection between the base panel 30 and the front panel 50, according to an embodiment.

Figure 7:
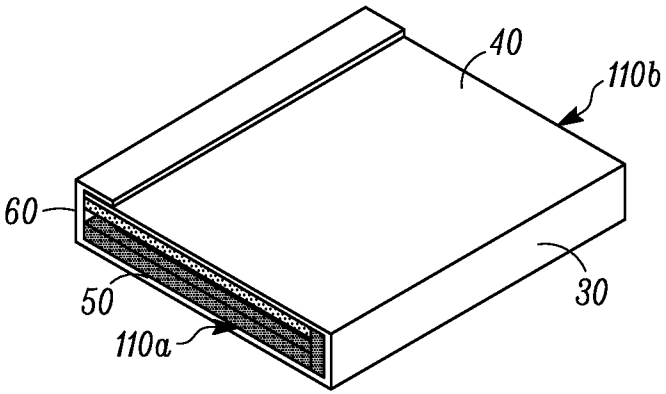
FIG. 7 illustrates another stage of the packaging process including closing the packaging system around the display device, according to an embodiment.
Figure 6:
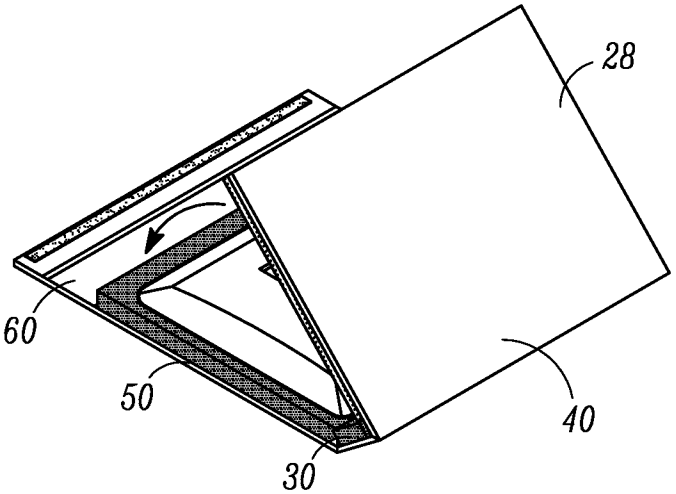
FIG. 6 illustrates the next stage of the packaging process including folding the packaging system around the display device, according to an embodiment.

The front panel 50 also includes an upper edge 54 where it is integrally joined to an upper panel 60 along a hinge 62 defining a hinge axis that extends from the side edge 22*a* to the side edge 22*b* parallel to the end edges 24*a*, 24*b* and perpendicular to the side edges 22*a*, 22*b*. The hinge 62 defines a fold axis or line along which the upper panel 60 and the front panel 50 can fold relative to each other while still maintaining the integral connection between the upper panel 60 and the front panel 50, according to an embodiment. The upper panel 60 can also include additional spaced hinges 64, 66 that define fold axes or lines permitting the upper panel 60 to fold over the exterior surface of the back panel 40 as best seen in FIGS. 6-7. The spacing of the hinges 64, 66 can accommodate different thicknesses of the display device 12. As evident from FIG. 2, the upper panel 60 includes the end edge 24*b*.

The overall size of the wrap member 20 from the side edge 22*a* to the side edge 22*b* (D in FIG. 2), and from the end edge 24*a* to the end edge 24*b*, can be selected based on the size of the display device 12 to be packaged. In one embodiment, the overall size of the wrap member 20 can also be selected based on the size of a pallet on which the packaging system 10 will be placed for transport. In such an embodiment, the wrap member 20 may be sized to accommodate a range of display device sizes (e.g., having a display screen ranging from 32 inches to 42 inches) and fit onto a standard pallet (e.g., a pallet dimensioned 48 inches by 40 inches) without extending beyond the pallet.

A back foam panel 70 is fixed to the interior surface 26 of the back panel 40. In the illustrated embodiment, the foam panel 70 covers a majority of the surface area of the interior surface 26 of the back panel 40, and includes two edges 72*a*, 72*b* thereof that are contiguous with the side edge 22*b* and the end edge 24*a*. An edge 72*c* of the foam panel 70 is spaced from the hinges 42, 44 and an edge 72*d* is spaced from the side edge 22*a*. The foam panel 70 has a dimension D3 between the edges 72*a* and 72*d*. The dimension D3 is generally less than the dimension D of the wrap member 20. The foam panel 70 also has a thickness T3 (FIG. 1), which can vary depending on, for example, the type of foam selected and the particular embodiment. It is to be appreciated that the thickness T3 can be the same as or different from the thicknesses T1 and T2.

In use, the foam panel 70 is designed to be engaged with a backside of the display device 12. The backsides of display devices tend to have differing shapes and sizes based on the manufacturer and model. The foam material of the foam panel 70 is selected to support the display device 12 in position while taking up the different shapes of the different back panels of different display devices and to allow for variation in thicknesses between different models. In one embodiment, the foam panel 70 is a lower density foam than the foam panels 80, 90 such as, but not limited to, a convoluted foam of a type known in the art.

A base foam panel 80 is fixed to the interior surface 26 of the base panel 30. In the illustrated embodiment, the foam panel 80 covers a majority of the surface area of the interior surface 26 of the base panel 30, and includes two edges 82*a*, 82*b* thereof that are contiguous with the side edges 22*a*, 22*b*. An edge 82*c* of the foam panel 80 is spaced from the hinge 42 and an edge 82*d* is spaced from the hinge 52. As illustrated in FIG. 2, the foam panel 80 has a dimension D2, which is about the same as the dimension D of the support member 20 as described above. The foam panel 80 also has a thickness T2 (FIG. 1), which can vary depending on, for example, the type of foam selected and the particular embodiment. It is to be appreciated that the thickness T2 can be the same as or different from the thicknesses T1 and T3.

In use, the foam panel 80 is designed to support the weight of the display device 12 when the packaged display device is stood upright and to absorb vibration during transit. The foam material of the foam panel 80 is of a different type than, and has a higher density than, the foam material of the foam panel 70. The foam material of the foam panel 80 can be for example, but not limited to, closed-cell polyethylene foam of a type known in the art.

A front foam panel 90 is fixed to the interior surface 26 of the front panel 50. In the illustrated embodiment, the foam panel 90 covers a majority of the surface area of the interior surface 26 of the front panel 50, and includes an edge 92*a* thereof that is contiguous with the side edge 22*b*, an edge 92*b* that is spaced from and parallel to the hinge 52, an edge 92*c* that is spaced from the side edge 22*a*, and an edge 92*d* that is spaced from the hinge 62. As illustrated in FIG. 2, the foam panel 80 has a dimension D1 between the edges 92*a* and 92*c*. The dimension D1 is generally less than the dimension of the wrap member D. In one embodiment, the dimension D1 of the foam panel 90 can be greater than the dimension D3 of the foam panel 70. The foam panel 90 also has a thickness T1 (FIG. 1), which can vary depending on, for example, the type of foam selected and the particular embodiment. It is to be appreciated that the thickness T1 can be the same as or different from the thicknesses T2 and T3.

In use, the foam panel 90 is designed to face the display screen of the display device 12 which is the most vulnerable part of the display device 12, and is typically flat and requires protection from impacts particularly of a point loading nature. In one embodiment, the foam material of the foam panel 90 is of the same type of foam as the foam panel 80, for example, but not limited to, closed-cell polyethylene foam of a type known in the art. The higher density foam of the front foam panel 90 can spread loads over a wider area and can reduce the risk of the screen cracking.

Each of the foam panels 70, 80, 90 can be secured to its respective panel 40, 30, 50, respectively, in any suitable manner in order to fixedly attach the foam panels 70, 80, 90 to the wrap member 20 so that the foam panels 70, 80, 90 do not shift positions prior to or during use. Examples of suitable attachment mechanisms include, but are not limited to, glue, tape, and the like, along with suitable combinations thereof.

Figure 5:
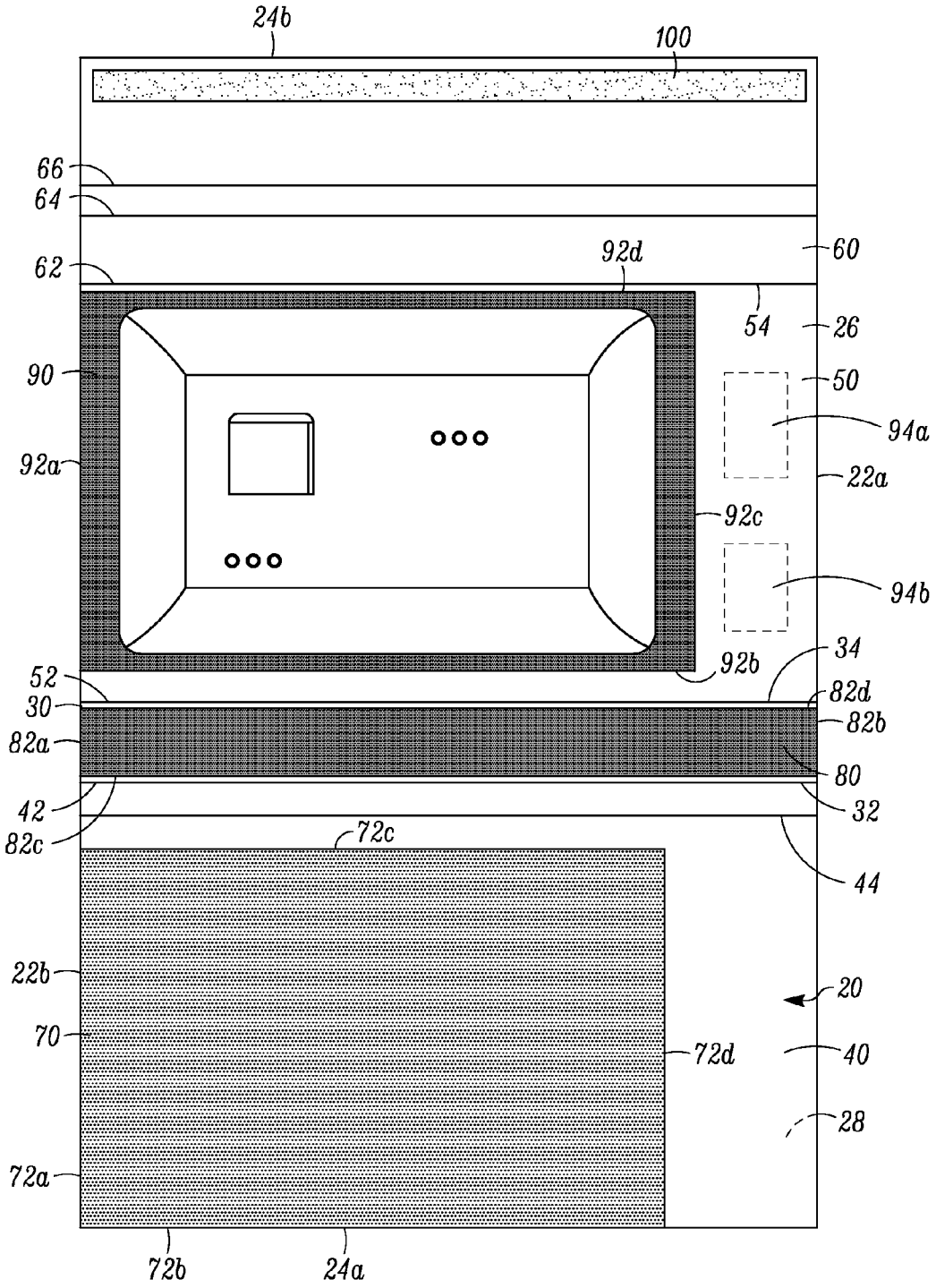
FIG. 5 is a top view of FIG. 4 also showing placement of a display stand and accessories, according to an embodiment.

As evident from FIG. 2, the foam panels 70, 90 are not centered on the interior surface of the wrap member 20 so that the foam panels 70, 90 are positioned closer to the side edge 22*b* than they are to the side edge 22*a*. This leaves space between the edges 72*d*, 92*c* and the side edge 22*a* for positioning of miscellaneous items such as a display device stand 94*a* and accessories 94*b* to be packaged with the display device 12, for example (shown in FIG. 5).

As illustrated in FIG. 2, a strip of adhesive material 100 is disposed on the interior surface 26 of the upper panel 60 near the end edge 24*b*. The adhesive material 100 can be any adhesive material that can adhere to the exterior surface 28 of the back panel 40 when the wrap member 20 is in the closed, folded configuration to retain the wrap member 20 in the closed, folded configuration. The adhesive material 100 can be for example, but not limited to, double-sided adhesive tape. However, other techniques for retaining the wrap member 20 in the closed, folded configuration can be used in addition to or separately from the adhesive material 100, for example exterior straps that are fixed to or separate from the wrap member 20, exterior tape or wrapping material, metal staples, and other fastening elements known in the art.

Figure 8:
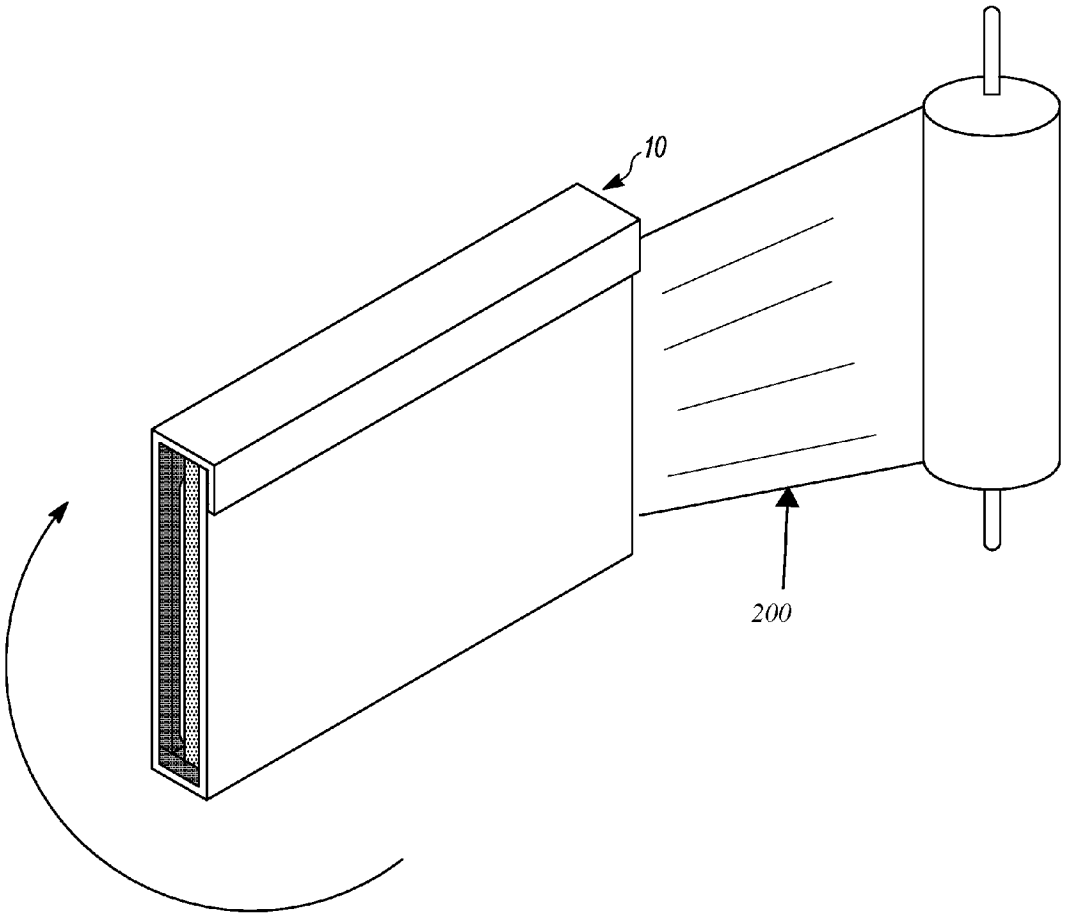
FIG. 8 illustrates wrapping material being wound around the ends of the packaging system of FIG. 7 to close the open ends of the packaging system, according to an embodiment.

As evident from FIG. 7, when the wrap member 20 is folded, ends 110*a*, 110*b* of the packaging will be open. To close the ends 110*a*, 110*b*, stretch wrapping material 200 (shown in FIG. 8) can be optionally wound around the folded wrap member 20 including around the ends 110*a*, 110*b*. Other techniques for closing the ends 110*a*, 110*b* can be used. For example, exterior straps can be deployed around the wrap member including around the ends 110*a*, 110*b*, or flap panels can be integrally formed on the side edges 22*a*, 22*b* of the wrap member 20 such that when the wrap member 20 is in the closed, folded configuration, the flap panels can be folded over the opens ends 110*a*, 110*b* and suitably secured to the wrap member 20 to close the open ends 110*a*, 110*b*.

Figure 3:
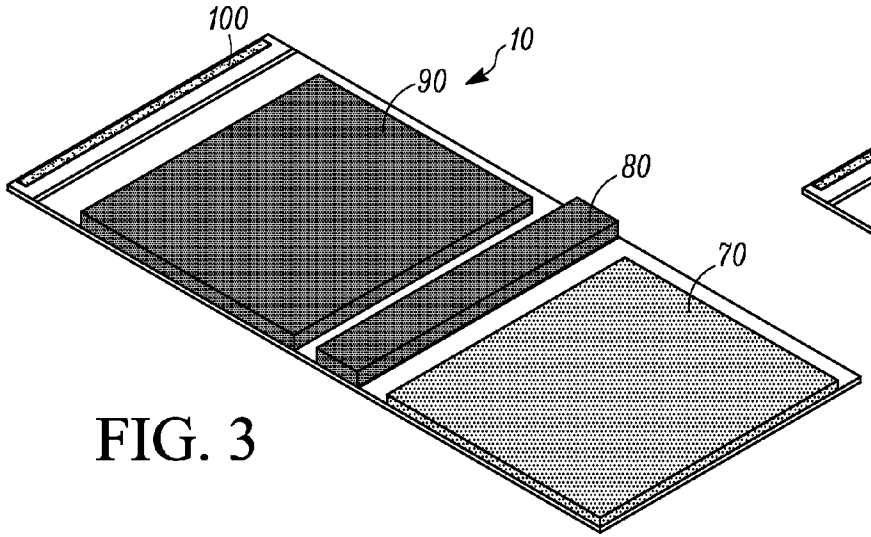
FIG. 3 illustrates the packaging system at an initial stage of a process of packaging a flat screen display device, according to an embodiment.
Figure 9:
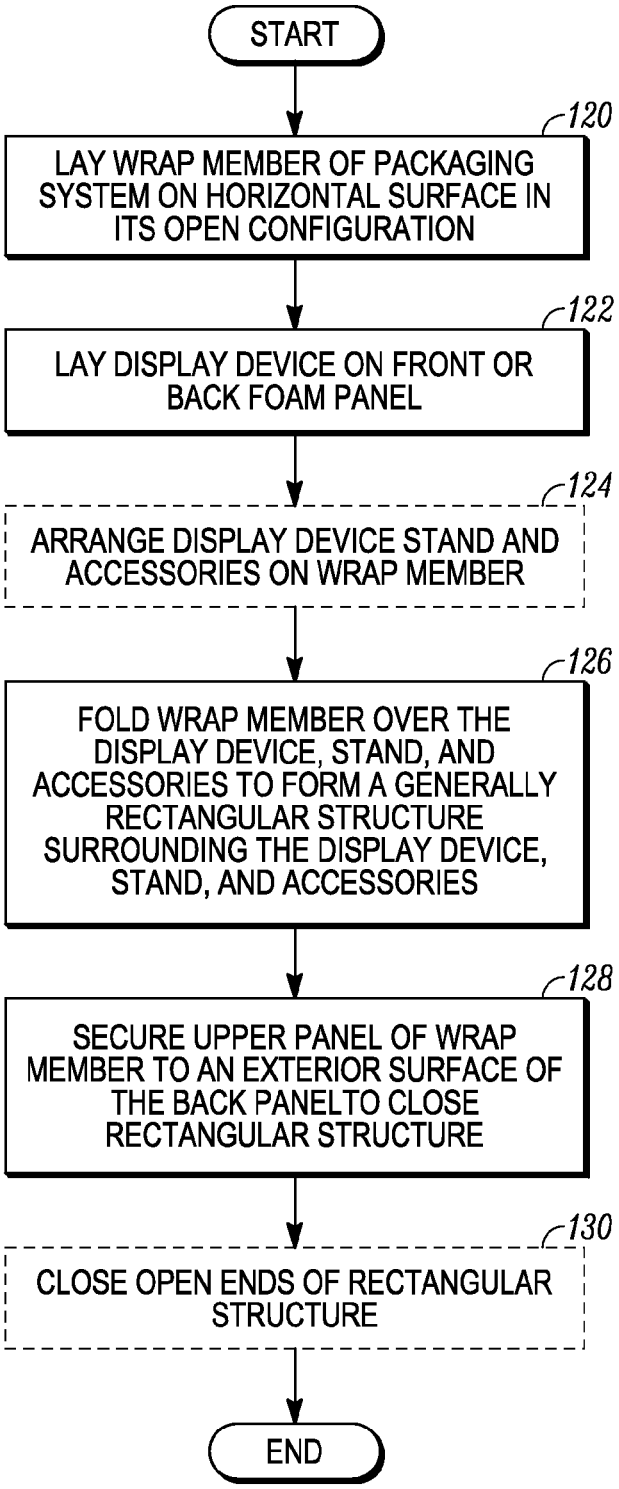
FIG. 9 illustrates a method of packaging a display device using the packaging system as described herein, according to an embodiment.

With reference to FIGS. 3-7 together with FIG. 9, operation and use of the packaging system 10 is as follows. In an initial step 120, the wrap member 20 is disposed on a support surface, such as on a floor or a table, in the open, flat configuration with the interior surface 26 facing upward as shown in FIG. 3. The particular packaging system 10 selected can be based, for example, on the size of the display device 12. In some embodiments, the packaging system 10 can include markings to indicate what size of display devices 12 can be stored therein. In some embodiments, a user may have to remove components of the display device 12 prior to step 122. For example, the user may have to remove the display device stand 94*a* and/or accessories 94*b*. In other embodiments, the display device stand 94*a* and/or accessories 94*b* may already be removed.

Figure 4:
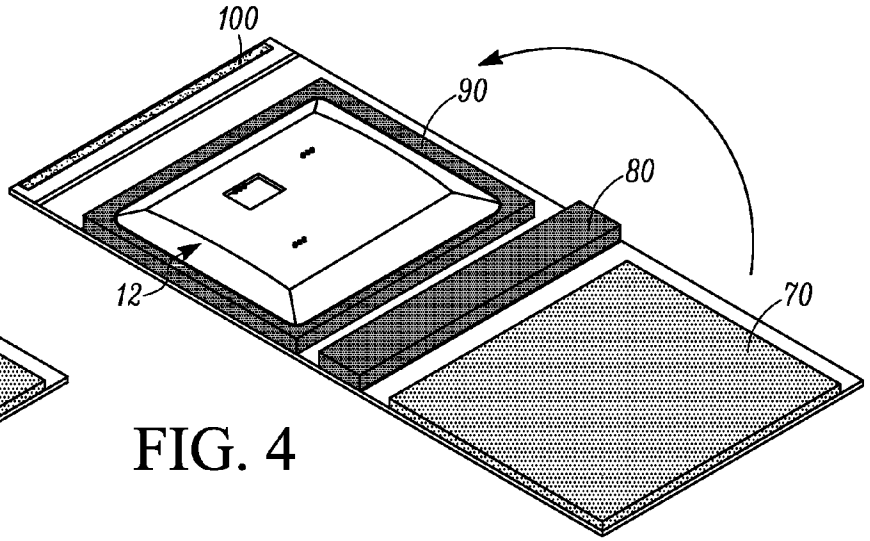
FIG. 4 illustrates the next stage of the packaging process where the flat screen display device is disposed on the packaging system, according to an embodiment.

In step 122, the display device 12 is then laid screen-side down on the foam panel 90 as shown in FIG. 4. It is to be appreciated that the display device 12 can alternatively be laid screen-side up on the foam panel 70, according to an embodiment. Optionally, if there is the display device stand 94*a* and/or accessories 94*b*, the accessories can be wrapped (e.g., in bubble wrap, or the like) and placed on the interior surface 26 of the front panel 50 at step 124. It is to be appreciated that optional step 124 can alternatively be performed after steps 126 and/or 128. The wrap member 20 is then folded over and around the display device 12 as shown in FIG. 6 to the closed, folded configuration (step 126), forming a generally rectangular structure with the back panel 40 and the foam panel 70 facing the front panel 50 and the foam panel 90, and the upper panel 60 facing the base panel 30 and the foam panel 80. The wrap member 20 is then closed in step 128 as shown in FIG. 7, for example by folding the upper panel 60 over the exterior surface 28 of the back panel 40 and securing the upper panel 60 to the back panel 40 using the adhesive material 100. Optionally, in step 130, the open ends 110*a*, 110*b* can be closed, for example by stretch wrapping material 200 wound around the folded wrap member 20 including around the ends 110*a*, 110*b* or by other techniques as discussed above. The packaging system 10 can then, for example, be placed onto a pallet or other similar shipping container for transport, storage, or the like. In some embodiments, the packaging system 10 with the display device 12 can be set onto a pallet such that the base panel 30 is rested on the pallet surface.

The described embodiment(s) may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A packaging system, comprising:

a wrap member having a generally rectangular shape, an open, flat configuration, a closed, folded configuration, an interior surface, and an exterior surface;

wherein the wrap member includes:

a base panel with a back edge and a front edge;

a back panel joined to the back edge of the base panel along a hinge defining a hinge axis;

a front panel joined to the front edge of the base panel along a hinge defining a hinge axis, the front panel including an upper edge; and an upper panel joined to the upper edge of the front panel along a hinge defining a hinge axis;

a back foam panel fixed to the interior surface of the back panel and covering a majority of a surface area of the interior surface of the back panel, wherein the back foam panel is constructed of a first type of foam material;

a base foam panel fixed to the interior surface of the base panel and covering a majority of a surface area of the interior surface of the base panel, wherein the base foam panel is constructed of a second type of foam material different than the first type of foam material;

a front foam panel fixed to the interior surface of the front panel and covering a majority of a surface area of the interior surface of the front panel, wherein the front foam panel is constructed of the second type of foam material, wherein the wrap member is foldable along the hinge axes from the open, flat configuration to the closed, folded configuration, and at the closed, folded configuration the wrap member forms a generally rectangular structure with the front panel and the front foam panel facing the back panel and the back foam panel, and the upper panel facing the base panel and the base foam panel; and an adhesive strip fixed to the interior surface of the upper panel, the adhesive strip extending generally parallel to the hinge axes.

2. The packaging system of claim 1, wherein the wrap member is configured to package a flat screen display device therein when the wrap member is in the closed, folded configuration with a display screen of the flat screen display device facing the front foam panel, and a rear side of the flat screen display device facing the back foam panel.

3. The packaging system of claim 1, wherein the first type of foam material comprises convoluted foam, and the second type of foam material comprises closed cell polyethylene foam.

4. The packaging system of claim 1, wherein the wrap member includes opposite side edges generally perpendicular to the hinge axes, and opposite end edges generally parallel to the hinge axes;

the base foam panel extends from one of the side edges to the other side edge;

the back foam panel has two edges thereof that are generally contiguous with the one of the side edges and one of the end edges; and the front foam panel has an edge that is generally contiguous with one of the side edges.

5. The packaging system of claim 4, wherein the back foam panel and the front foam panel are positioned closer to one of the side edges than to the other of the side edges.

6. The packaging system of claim 3, wherein the wrap member comprises corrugated cardboard.

7. The packaging system of claim 1, wherein the back foam panel is a smaller width than the wrap member such that one or more accessories are storable in the packaging system.

8. The packaging system of claim 2, wherein the wrap member is configured to package a flat screen display device in the form of a flat screen television or a flat screen computer monitor.

9. A packaging apparatus, comprising:

a support substrate having opposite side edges generally perpendicular to opposite end edges, an interior surface and an exterior surface, and the support substrate is foldable from an open configuration to a closed configuration to package an object therein;

cushioning means fixed to the interior surface of the support substrate and positioned for cushioning a front side of the object when the support substrate is folded to the closed configuration;

cushioning means fixed to the interior surface of the support substrate and positioned for cushioning a side of the object when the support substrate is folded to the closed configuration; and cushioning means fixed to the interior surface of the support substrate and positioned for cushioning a rear side of the object opposite the front side when the support substrate is folded to the closed configuration, wherein the cushioning means for the front side of the object and the cushioning means for the rear side of the object are offset from a central axis of the support substrate such that the cushioning means for the front side of the object and the cushioning means for the rear side of the object are positioned closer to one of the side edges than they are to the other side edge, the cushioning means for the side edge of the object extends from one of the side edges to the other side edge, the cushioning means for the rear side of the object has two edges thereof that are respectively contiguous with one of the side edges and one of the end edges, and the cushioning means for the front side of the object has an edge that is contiguous with one of the side edges.

10. The packaging apparatus of claim 9, wherein when the support substrate is in the open configuration, the cushioning means for the front side of the object, the cushioning means for the rear side of the object, and the cushioning means for the side of the object are not directly connected to one another.

11. The packaging apparatus of claim 9, wherein the cushioning means for the front side of the object and the cushioning means for the side of the object each comprises foam having a first density, and the cushioning means for the rear side of the object comprises foam having a second density that is lower than the first density.

12. The packaging apparatus of claim 11, wherein the foam having the first density comprises closed cell polyethylene foam and the foam having the second density comprises convoluted foam.

13. The packaging apparatus of claim 9, wherein the cushioning means for the rear side of the object, the cushioning means for the side of the object, and the cushioning means for the front side of the object each extend a different distance between the opposite side edges.

14. The packaging apparatus of claim 9, further comprising an adhesive strip fixed to the interior surface between the cushioning means for the front side of the object and one of the end edges, the adhesive strip extends generally parallel to the one end edge.

15. A method of packaging a display device for shipment, comprising:

disposing a wrap member on a support surface in an open, flat configuration with an interior surface thereof facing upward, the wrap member including:

a base panel, a back panel; a front panel; and an upper panel;

a back foam panel fixed to the interior surface of the back panel and covering a majority of a surface area of the interior surface of the back panel, the back foam panel is constructed of a first type of foam;

a base foam panel fixed to the interior surface of the base panel and covering a majority of a surface area of the interior surface of the base panel, the base foam panel is constructed of a second type of foam different than the first type of foam;

a front foam panel fixed to the interior surface of the front panel and covering a majority of a surface area of the interior surface of the front panel, the front foam panel is constructed of the second type of foam;

laying the display device screen-side down on the front foam panel;

folding the wrap member over the display device to form a generally rectangular structure with the back panel and the back foam panel facing the front panel and the front foam panel, and the upper panel facing the base panel and the base foam panel; and securing the upper panel to an exterior surface of the back panel using a double sided adhesive tape that is fixed to the interior surface of the upper panel.

16. The method of claim 15, wherein the generally rectangular structure includes open ends, and further comprising closing the open ends.

17. The method of claim 16, wherein closing comprises wrapping stretch wrap around the generally rectangular structure including the open ends.

* * * * *